United States Patent [19]

Wade, Jr.

[11] 4,252,061

[45] Feb. 24, 1981

[54] DATING WHEELS

[76] Inventor: Charles E. Wade, Jr., 81 Myrtle Dr., Manahawkin, N.J. 08050

[21] Appl. No.: 76,162

[22] Filed: Sep. 17, 1979

[51] Int. Cl.[3] ..... B41F 13/10

[52] U.S. Cl. ..... 101/377; 400/175

[58] Field of Search ..... 101/377, 375, 376, 378, 101/374, 371, 106, 109–110, 378; 400/174–175, 172

[56] References Cited

U.S. PATENT DOCUMENTS

| | | | |
|---|---|---|---|
| 175,140 | 3/1876 | Myers | 101/377 |
| 1,102,104 | 6/1914 | Stigberg | 101/377 |
| 2,674,185 | 4/1954 | Davidson | 101/377 X |
| 2,746,389 | 5/1956 | Alessi, Jr. et al. | 101/377 |
| 2,874,637 | 2/1959 | Grevich | 101/377 |
| 3,186,337 | 6/1965 | Hill | 101/377 |

FOREIGN PATENT DOCUMENTS

| | | | |
|---|---|---|---|
| 2805776 | 8/1978 | Fed. Rep. of Germany | 101/35 |
| 2372704 | 8/1978 | Fed. Rep. of Germany | 101/377 |

*Primary Examiner*—E. H. Eickholt

*Attorney, Agent, or Firm*—Frederick J. Olsson

[57] ABSTRACT

Dating wheel with a tracer symbol unit which can be manually inserted on or removed from the wheel. To change the tracer symbol, the operator simply uses thumb and forefinger to grasp the unit and extract same and then replace with an identical unit having a different symbol. This can be done without slowing or stopping the cases or other medium being printed. There is no machine down-time.

2 Claims, 5 Drawing Figures

DATING WHEELS

This invention relates in general to industrial printing of shipping containers and like items. More particularly the invention relates to improvements in dating wheels used to print dates on containers as the same are moved along a line by a conveyor.

In connection with such dating it is desirable and customary to print a tracer symbol which provides a means for identifying those containers which were printed during a certain hour of the work-day normally every one-half hour. In this way, defective containers or contents can be more precisely traced or located.

For the above purposes it is conventional to stop the conveyor and replace the dating wheel. During a work day the stoppage results in a substantial reduction in production.

The primary object of the invention is to provide an improved dating wheel which eliminates down-time.

The invention contemplates a dating wheel having a tracer symbol unit mounting the tracer type, the unit being manually insertable and removable without stopping the conveyor line and thus provide means for tracer change without down-time. The tracer symbol can be more frequently changed thus improving the identifying function of the tracer.

The invention will be explained below in connection with the following drawings wherein:

FIG. 3 is an enlarged plan view of a section of the dating wheel of FIG. 1;

FIG. 4 is a sectional elevational view taken along the line 4—4 of FIG. 3; and

FIG. 5 is a sectional view taken along the lines 5—5 of FIG. 4.

Figure 1:
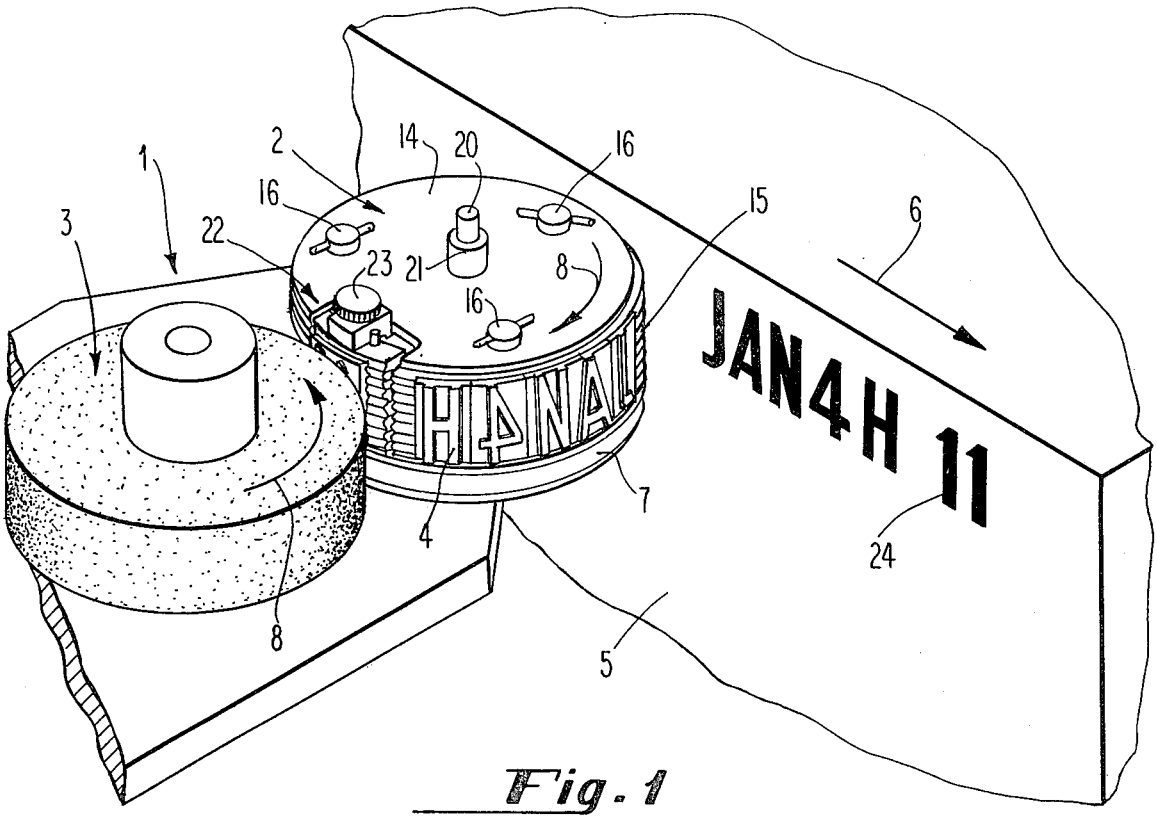
FIG. 1 is a prospective view of the general relationship between a dating wheel, its inker and container to be printed, the dating wheel incorporating the invention.

In FIG. 1 a platform 1 rotatably mounts the dating wheel 2 and the inking wheel 3 of which supplies ink to the flexible type 4 on dating wheel 2. The platform is pivotally mounted and is spring biased to urge the dating wheel against the container or carton 5. The carton 5 is mounted on a conveyor not shown for movement in a direction indicated by the arrow 6.

The dating wheel is rotated by motion of the carton. The drive is provided by both the O-ring 7 and the flexible type 4 engaging the carton. When the type 4 is out of contact with the carton, the ring 7 provides the drive and when the type 4 engages the carton it provides the drive. The dating wheel and inker rotate as noted by arrows 8.

Figure 2:
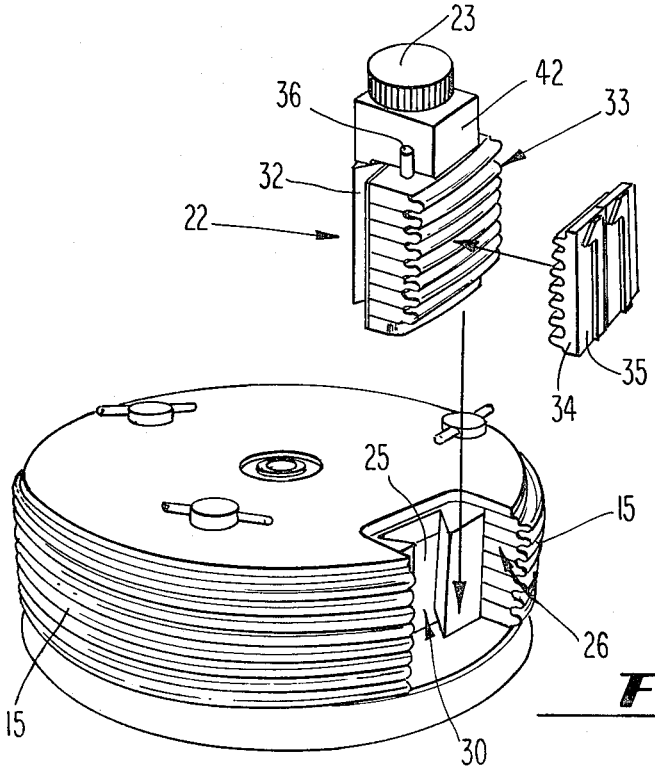
FIG. 2 is an exploded view of the dating wheel of FIG. 1.

The dating wheel 2 has a main frame 10 (FIG. 4) of generally hat-shaped construction comprising a base section 11, wall section 12, top section 13 and clamp plate 14. The main frame mounts a stack of type-rings 15 (FIGS. 1 and 2). The rings and type are configured so that the outer ends of the rings and inner protrusions on the type 4 form intermeshing tongues and grooves by which the type 4 is held on the wheel. The rings are held in position by the clamp plate 14 which is forced against the rings by the hand nuts 16 threaded in the wall section 12.

To change type, the nuts are turned to loosen the clamp plate which frees the rings; the old type removed and new type inserted and the rings secured again.

The spindle 20 mounted on platform 1 makes a rotary connection with the top section 13 of the main frame. A collar 21 held on the spindle by a set screw bears on the clamp plate 14 and prevents the wheel 2 from lifting off the spindle.

The foregoing elements are of conventional construction except that the rings and the main frame have been modified in accordance with the invention as will be explained below.

The invention contemplates a tracer unit 22 which can be removed from the wheel by grasping the knob 23 between the thumb and forefinger and pulling upwardly and which can be inserted by the reverse operation.

Referring to FIG. 1, the tracer symbol comprises the numeral 11 as indicated at 24. To change tracer symbol, the operator waits until the installed unit prints its tracer symbol and then, while the wheel is rotating, lifts out the unit and replaces with another unit having a new tracer symbol.

It will be apparent that the use of the tracer unit 22 eliminates down-time. Thus, tracer control can be made more precise by increasing the frequency of change and this can be done with no decrease in production.

Returning now to the details of the invention, the wall 12 of the main frame provided with a dove-tail key way 25 and each ring 15 is formed with an opening. The corresponding opposite edges forming one side of the openings are in vertical alignment as indicated at 26 and in FIG. 2. The corresponding edges forming the other side of the openings are similarly vertically aligned as indicated at 27 in FIG. 5.

The aligned edges 26 and 27, part of the wall 12 and part of the base 11 form a channel 30 into which the unit 22 is inserted and removed.

The unit 22 includes the carrier 31 which has a dove-tail key 32 adapted to slidably fit into the key way 25. When the key is in the key way the carrier is disposed in channel 30 resting on the base section 11 and extending between the vertically aligned edges 26 and 27 as best noted in FIGS. 4 and 5.

The carrier 31 mounts a plurality of segments of type rings 33 adapted to support the tracer mount 34 (FIG. 2) carrying the tracer symbol type 35. The segments 33 are aligned by virtue of the pins 36 secured to the carrier 31. As noted in FIG. 4, the outer edges 40 of the type ring segments 33 are configured to receive fingers 41 on the tracer mount 34 and hold the mount and type 5 secure. The segments are held fast by the clamp 42 under the control of screw knob 23 threaded in the wall section 12.

To change tracer symbol, the segments 33 are loosened by clamp 42, the installed tracer mount and tracer type removed and replaced by a new mount and type and the clamp operated to secure the segments 33 and thus hold the new type in position.

I claim:

1. In a rotary dating wheel including a main frame for mounting the wheel for rotation and removably supporting a stack of type-rings for removably supporting dating type thereon for printing dating symbols, the improvement comprising:

a vertically extending key-way formed in said frame;

a plurality of openings respectively formed in said type-rings, each type-ring having a pair of opposite edges forming its opening and the corresponding edges on one side of the type-rings being in substantial vertical alignment and the corresponding edges on the opposite side also being in substantial vertical alignment, said opposite edges and said main frame forming a channel;

a carrier slidably mounted in said channel and having a key in said key-way for maintaining the carrier in the channel and providing for the carrier to be manually moved into and out of the channel;

a plurality of segments of type-rings stacked on said carrier and extending between said opposite edges, the segments being for use in supporting type having a tracer symbol thereon to print a tracer symbol in conjunction with the printing of the dating symbols by said dating type;

alignment means on said carrier for removably maintaining said segments in stacked condition on the carrier;

clamp means on the carrier for clamping said segments in position; and lift means on said carrier to be grasped by the fingers of an operator for moving the carrier and a tracer symbol thereon in and out of said channel.

2. In a rotary dating wheel including a main frame for mounting the wheel for rotation and removably supporting a stack of type-rings for removably supporting dating type thereon for printing dating symbols, the improvement comprising:

a plurality of openings respectively formed in said type-rings, each type-ring having have a pair of opposite edges forming its opening and the corresponding edges on one side of the type-rings being in substantial vertical alignment and the corresponding edges on the opposite side also being in substantial vertical alignment, said opposite edges and said main frame forming a channel, a carrier slidably mounted in said channel between said opposite edges;

means connecting the carrier to the main frame for maintaining the carrier in the channel and providing for the carrier to be manually moved in and out of the channel;

a plurality of segments of type-rings stacked on said carrier and extending between said opposite edges, the segments being for use in supporting type having a tracer symbol thereon to print a tracer symbol in conjunction with the printing of the dating symbols by said dating type;

mechanism on said carrier to removably retain said segments on the carrier; and lift means on said carrier to be grasped by the fingers of an operator for moving the carrier and a tracer symbol thereon in and out of said channel.

* * * * *